United States Patent [19]

Vercelletto

[11] 4,240,233

[45] Dec. 23, 1980

[54] PREFABRICATED WALL DESIGNED IN PARTICULAR FOR THE CONSTRUCTION OF DWELLING HOUSES

[76] Inventor: Michel Vercelletto, 1, rue de la Chauvinière, F-72600 Mamers, France

[21] Appl. No.: 31,865

[22] Filed: Apr. 20, 1979

[30] Foreign Application Priority Data

Apr. 26, 1978 [FR] France ..... 78 12295
Sep. 21, 1978 [FR] France ..... 78 27042

[51] Int. Cl.[3] ..... E04G 9/04; E04G 11/06; E04B 2/28

[52] U.S. Cl. ..... 52/127; 52/91; 52/410; 52/426; 52/508; 52/565; 52/714

[58] Field of Search ..... 52/410, 426, 383, 378, 52/513, 508, 565, 714

[56] References Cited

U.S. PATENT DOCUMENTS

| | | | |
|---|---|---|---|
| 1,434,915 | 11/1922 | Scholfield | 52/410 X |
| 1,764,729 | 6/1930 | Koch | 52/513 X |
| 1,767,065 | 6/1930 | Goldsmith | 52/378 |
| 1,832,231 | 11/1931 | Menninger | 52/378 |
| 1,897,327 | 2/1933 | Olson | 52/410 |
| 2,543,939 | 3/1951 | Rumble | 52/383 X |
| 3,286,421 | 11/1966 | Branstrator | 52/383 X |
| 3,744,202 | 7/1973 | Hubmann | 52/383 X |

FOREIGN PATENT DOCUMENTS

| | | | |
|---|---|---|---|
| 1214534 | 11/1959 | France | 52/378 |
| 2232647 | 1/1975 | France | 52/410 |
| 345140 | 4/1960 | Switzerland | 52/378 |
| 252103 | 5/1926 | United Kingdom | 52/378 |
| 751085 | 6/1956 | United Kingdom | 52/378 |

*Primary Examiner*—Alfred C. Perham
*Attorney, Agent, or Firm*—Michael J. Striker

[57] ABSTRACT

An insulating inner panel and an outer panel are assembled together so as to form an internal space which is subsequently filled with light concrete. U-section members or flanged channel bars having uniformly spaced slots are flush-mounted within superposed horizontal channels of the inner panel. At the ends of the wall, metallic fastening pins pass through the slots and the insulating panel and pass round upright members forming part of vertical end beams against which the inner panel is applied. Between the wall ends, the fastening pins are each constituted by a loop having twisted ends and two free end portions which are passed through packing-blocks placed within the internal space and are anchored in the outer panel.

7 Claims, 13 Drawing Figures

FIG_1
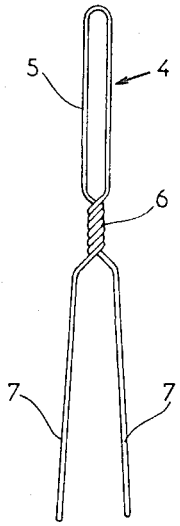
FIG_2
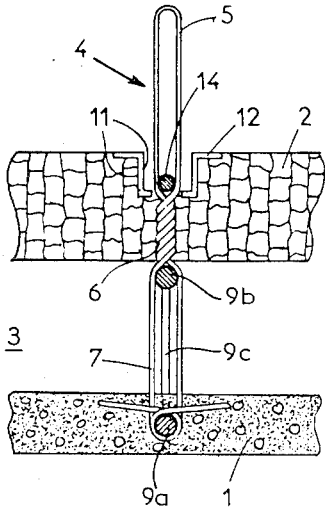
FIG_3
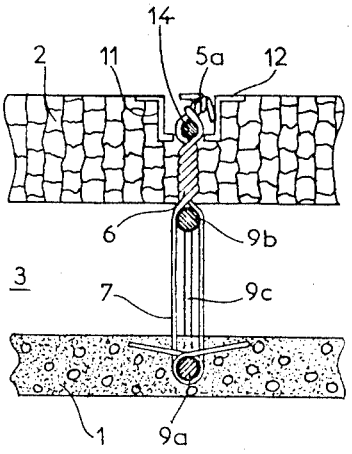
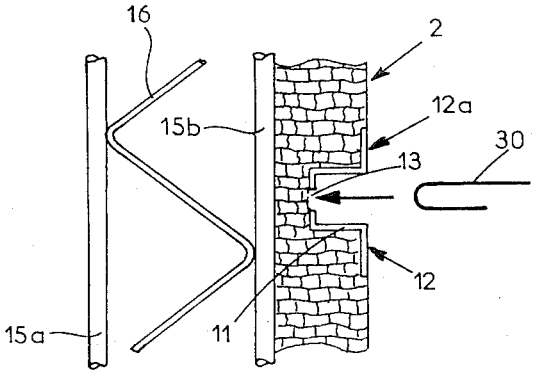
FIG_11
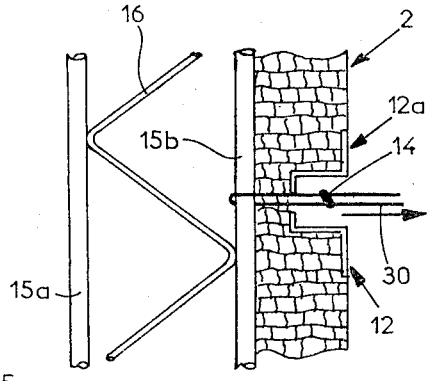
FIG_12
FIG_6
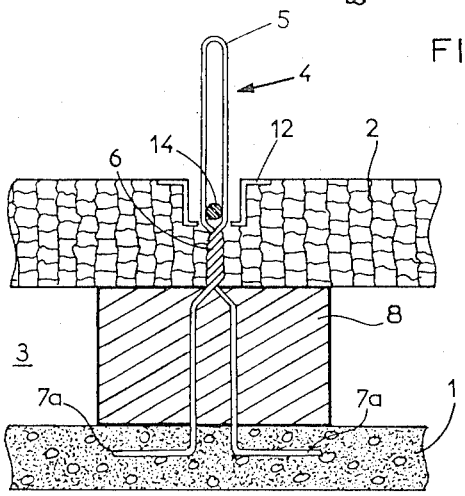

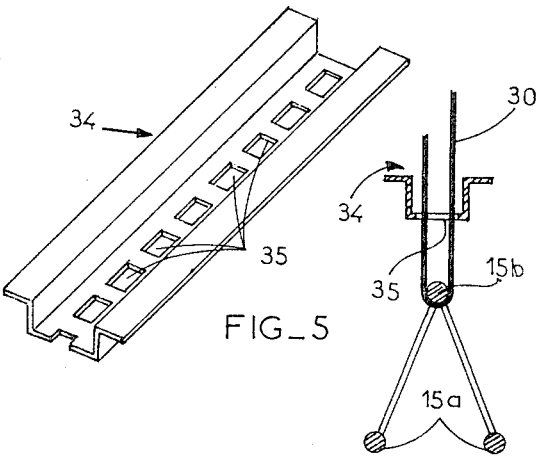
FIG_5
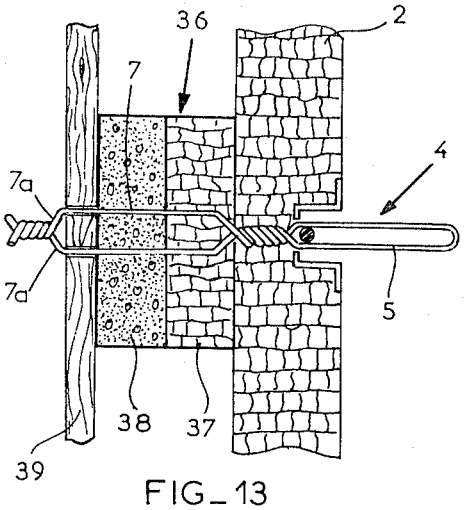
FIG_13
FIG_9
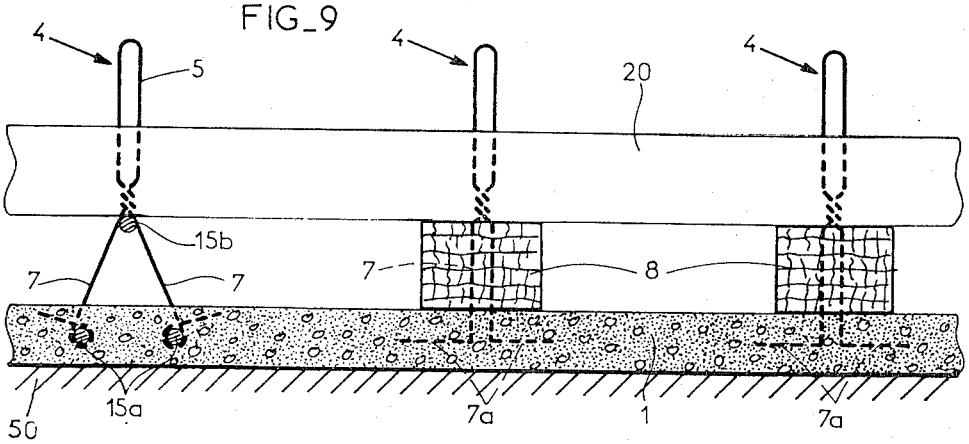
FIG_10
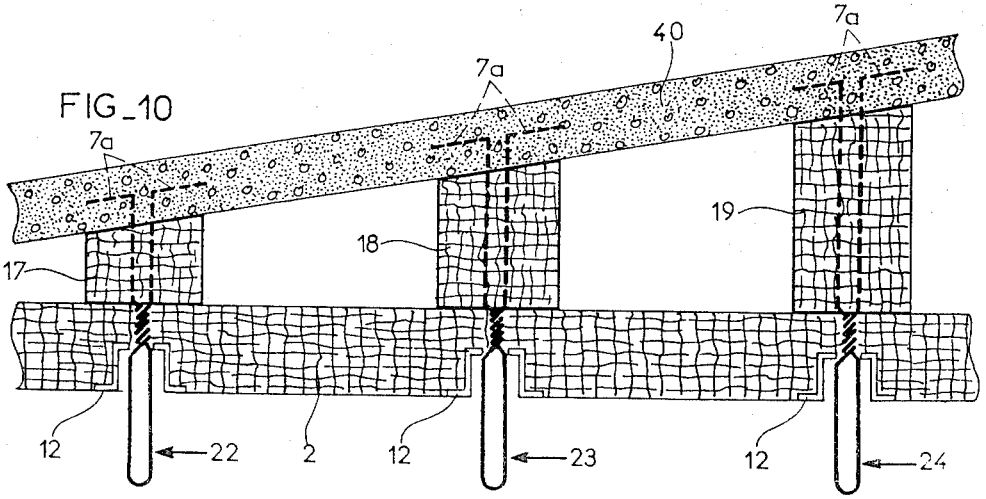

PREFABRICATED WALL DESIGNED IN PARTICULAR FOR THE CONSTRUCTION OF DWELLING HOUSES

This invention relates to a prefabricated wall which is primarily intended for the construction of dwelling houses but is not limited to this particular application. In fact, a wall of this type can also be employed in other buildings.

A known design of prefabricated wall for a dwelling house has already been disclosed, for example, in French patent No. 73 20755. A wall of this type is constituted by an inner insulating panel and an outer panel of reinforced concrete, coupling means being employed to interconnect the two panels in such a manner as to leave between these latter an internal space which can subsequently be filled with no-fines concrete or light concrete. In this wall, the coupling between the concrete panel and the insulating panel is formed by means of specially manufactured ladder-type structural elements.

The aim of the present invention is to make improvements in the construction of the walls aforesaid, especially in order to reduce the quantity of materials required and consequently the cost price of the wall.

In accordance with the invention, the prefabricated wall is distinguished by the fact that the insulating inner panel is provided with superposed horizontal channels fitted with U-section members or flanged channel bars having uniformly spaced slots and flush-mounted within said channels. A further distinctive feature lies in the fact that provision is made at the ends of the wall for coupling means comprising metallic fastening elements which pass through the slots as well as the insulating material and extend on each side of upright members forming part of end beams against which the inner panel is applied, said fastening elements being bent back within the sectional members. Between the ends of the panels, the coupling means provided between said panels comprise a series of metallic fastening pins disposed at intervals and each constituted by a loop, the ends of which are twisted and have extensions in the form of two free end portions. Said fastening pins are positioned in such a manner that their loops pass through the insulating inner panel whilst their free end portions pass through packing-blocks placed within the internal space and are anchored in the outer panel.

Thus the special ladder elements of the French patent cited earlier are replaced in this case at the ends of the wall by beams of types which are already known in other applications and are designed by way of example in the form of ladders. Between the ends of the wall, the special ladder-type structural elements mentioned in the foregoing are replaced by a series of packing-blocks which cooperate with the fastening pins in order to provide a coupling between the insulating inner panel and the outer panel.

In comparison with known practice in the prior art, the invention therefore permits a substantial economy of materials as well as a very appreciable saving of time both in manufacture and in positioning of the wall.

Further distinctive features and advantages of the invention will become apparent from the following description relating to a number of embodiments of the invention, reference being made to the accompanying drawings which are given by way of example without any limitation being implied, and wherein:

FIG. 1 is a view in elevation of a metallic fastening pin employed in the prefabricated wall in accordance with the invention;

FIG. 2 is a horizontal sectional view with portions broken away and showing the coupling between the two panels at one end of the wall in accordance with a first embodiment of the invention and prior to twisting of the metallic fastening pin;

FIG. 3 is a view which is similar to FIG. 2 and shows the loop of the metallic fastening pin after twisting within the interior of the corresponding sectional member which is flush-mounted within the insulating inner panel;

FIG. 5 is an explanatory diagram showing one form of construction of the ends of the wall in accordance with the invention, in which the vertical beams comprise three supporting uprights in the form of rods disposed in a triangle;

FIG. 6 is a fragmentary horizontal sectional view showing the coupling between the two panels of the wall between the ends of this latter;

FIG. 9 is a fragmentary vertical sectional view of the wall in accordance with the invention while fabrication of the wall is in progress;

FIG. 10 is a diagrammatic vertical sectional view of another embodiment of the invention in which the wall is employed as a platform roof or as a sloping floor;

FIGS. 11 and 12 are diagrammatic views in elevation and in section showing two successive stages of assembly of the hooking pins at the ends of the wall in accordance with the invention, in one embodiment in which vertical beams having three rods or supporting uprights disposed in a triangle are placed at the ends of the wall as in FIG. 5;

FIG. 13 is a fragmentary view, partly in section and in vertical elevation showing an alternative form of construction of the wall.

Figure 7:
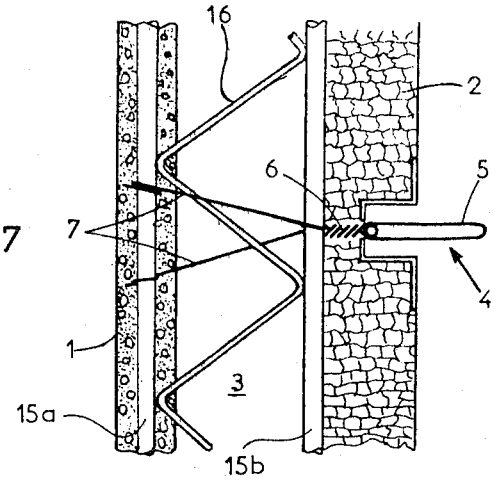
FIG. 7 is a fragmentary vertical sectional view showing the coupling between the two panels at the ends of a wall in accordance with a second embodiment of the invention.

In the embodiment which is illustrated in FIGS. 1 to 4 and 6, the prefabricated wall in accordance with the invention as primarily designed for the construction of dwelling houses but also of "three-dimensional modules" comprises an outer planel 1 of reinforced concrete and an inner panel 2 of insulating material such as polystyrene. Coupling means serve to assemble the walls 1, 2 in such a manner as to provide a gap of predetermined width between said walls, thus constituting an internal space 3 which will be filled in situ with light concrete or no-fines concrete.

In accordance with the invention, the coupling means for joining together the panels 1 and 2 comprise between the ends of the panels a series of metallic fastening pins 4 disposed at intervals and each constituted by a loop 5 (as shown in FIG. 1). The ends of said loop are twisted so as to form an intermediate zone 6 and are provided with extensions in the form of two free ends 7. Said fastening pins 4 are positioned in such a manner as to ensure that each loop 5 passes through the inner panel 2 which is formed of polystyrene, for example. Between the ends of the two panels, the free ends 7 of the fastening pins 4 pass through packing-blocks 8 placed within the internal space 3 (as shown in FIG. 6), said blocks being intended to be anchored in the outer concrete panel 1.

The packing-blocks 8 which are suitably arranged at intervals over the surface of the panels can be constructed of concrete or of polystyrene, for example. Alternatively, provision can be made for composite blocks of concrete and polystyrene. In the case of concrete packing-blocks, the block 8 is cast with the corresponding fastening pin 4. On the other hand, if said blocks are formed of polystyrene, the free ends 7 of a fastening pin are passed through the corresponding block 4.

The insulating inner panel 2 is provided with a series of superposed horizontal channels 11 formed on the inner face of said panel 2, sectional members in the form of flanged channel bars 12 being flush-mounted within said channels. Alternatively, said flanged channel bars could be replaced by U-section members.

Figure 4:
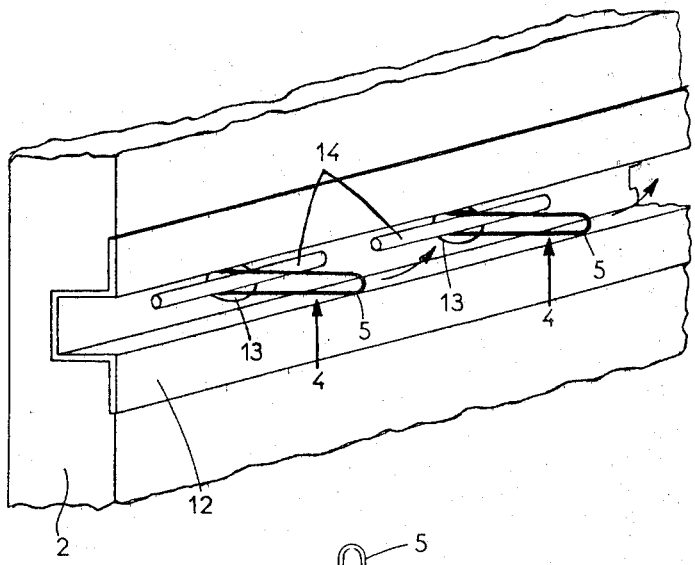
FIG. 4 is a fragmentary view in perspective of the insulating panel showing the loops of the fastening pins prior to twisting of these latter.

As shown in FIG. 4, elongated slots 13 are arranged at uniform intervals in the sectional members 12; the loops 5 of the fastening pins 4 are passed through said elongated slots 13 and bent back within the sectional members 12 after having been twisted around cylindrical rods which have been engaged within the loops 5.

At the ends of the panels 1, 2, a coupling between these latter is provided by means of vertical beams such as the beam 9 (shown in FIGS. 2 and 3), a beam 9 being placed at each end. Each beam 9 constituted by two vertical side-stringers or supporting uprights *9a*, *9b* which are joined together by means of cross-bars *9c* so as to form a ladder, this type of beam being already known per se. One of the supporting uprights of the ladder-beam 9 such as the upright *9a* as shown in FIGS. 2 and 3 is embedded in the concrete panel 1 whilst the second supporting upright *9b* is located within the internal space 3 and the free ends 7 of each fastening pin 4 are passed on each side of both supporting uprights *9a*, *9b* and bent back around the upright *9a*.

As the ends of the wall, the pins 4 thus constitute fastening elements which extend through the elongated slots 13 of the sectional members 12, through the insulating material 2, and pass around the vertical supporting uprights *9a*, *9b* whilst the loops 5 of said pins are bent back within the sectional members 12.

The procedure to be followed in order to mount the wall hereinabove described will now be explained.

The packing-blocks 8 are first secured to the corresponding fastening pins 4. If the blocks 8 are of concrete, said blocks are cast together with the fastening pins as mentioned in the foregoing; if they are of polystyrene, the free ends 7 of each fastening pin are inserted in the corresponding packing-block 8. The end portions *7a* (shown in FIG. 6) of the free ends 7 which project from the packing-blocks 8 are then twisted in order to be anchored in the concrete of the panel 1. The plate of insulating material constituting the panel 2 which is preferably of polystyrene is inwardly displaced with respect to the loops 5, said insulating plate having previously been grooved in order to form the superposed channels 11.

The perforated sectional members 12 are then placed within the channels 11, whereupon the small cylindrical rods 14 are inserted in the loops 5 as shown in FIG. 4 in the bottom of the channel of the sectional member 12. The loops 5 are then twisted around the cylindrical rods 14. On completion of this operation, the twisted loops *5a* are bent back within the sectional member 12 (FIG. 3) as indicated by the arrows in FIG. 4.

At each end of the wall, provision is made for a vertical beam 9, the supporting uprights *9a* of said beam being embedded in the concrete of the panel 1. The free ends 7 of the two series of corresponding loops 4 are secured by clamping the inner supporting uprights *9b* between the free ends 7 and against the twisted intermediate portion 6, whereupon the supporting uprights *9a* are surrounded by the end portions of the free ends 7 (as shown in FIGS. 2 and 3).

As mentioned earlier, the following stage of operation consists in inwardly displacing the panel 2 over the loops 5. A plaster-board plate (not shown in the drawings) is then attached to the inner face of the insulating panel 2; this attachment can be effected by screwing on the flanges of the sectional members 12. The plaster-board plates can also be replaced by a grid over which plaster is poured if it is desired to form the panel facing in a flat position.

Another possible alternative arrangement consists in bending-back the twisted loops *5a* against a netting element or grid which serves as a reinforcement for the facing plaster which is subsequently poured over the insulating panel 2.

The prefabricated wall which can be produced in accordance with the invention achieves a substantial economy both in materials and in time of assembly in comparison with walls of known types. It is thus possible to achieve a reduction of approximately 15% in the quantity of concrete which is necessary for the construction of a conventional wall of faced hollow concrete blocks.

Figure 8:
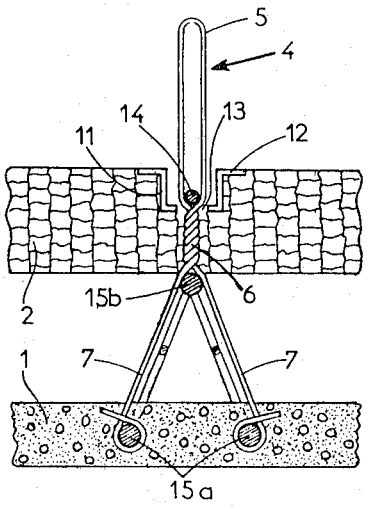
FIG. 8 is a fragmentary horizontal sectional view corresponding to FIG. 7.

In the embodiment shown in FIGS. 7 and 8, the coupling between the panels 1 and 2 is carried out at the ends of these latter by means of vertical beams which are known per se. Each beam is constituted by three round-bar members or supporting uprights *15a*, *15b* which are disposed in a triangle and interconnected by means of a wire framework 16. The two supporting uprights *15a* are embedded in the outer panel 1. The inner supporting member *15b* of each beam is therefore placed within the internal space 3 and applied against the intermediate twisted zone 6 between the free ends 7, the end portions of which are bent-back around the supporting uprights *15a* and thus embedded in the concrete of the panel 1.

The wall which is provided with edge beams of the type comprising three vertical upright members is in any case identical with the wall shown in FIGS. 1 to 4 and 6.

As illustrated in FIG. 9, a rule 20 is advantageously employed for each horizontal row of fastening pins 4 to which the corresponding pins are secured by means of a suitable locking system. Said rule is placed in position temporarily in order to permit alignment of the fastening pins 4 with the packing-blocks 8 and also of the horizontal faces of these latter with the beams which, at this stage, are placed horizontally on a supporting table 50 together with the outer panel.

Since the fastening pins 4 associated with a rule 20 are thus fixed at uniform intervals at the level of their loops 5, said pins are therefore locked in position beneath the bottom portion of the rule or beam 20 which in turn rests on end supporting frames. The result thereby achieved is perfect alignment of the packing-blocks 8 with the inner upright members of the end beams and it is possible in addition to place the packing-blocks 8 in position with a high degree of accuracy. The rules 20 are then removed and the insulating panel is placed in position as indicated earlier.

The prefabricated wall in accordance with the invention can be employed not only for forming the walls of a building but also as a platform roof or as a floor, thus offering an advantage in that the construction of the walls and of the roof can be carried out with the same tools and equipment. In this case, the free space between the horizontal wall and the roof is not filled with lightweight or no-fines concrete and results in the highly advantageous possibility of horizontal ventilation in hot countries.

Should it be desired to give a slight slope to the roof, the wall is constructed as shown in FIG. 10. In this form of construction, the intermediate packing-blocks 17, 18, 19 and so forth which are housed within the internal space between the two panels increase in height from one edge of the wall to the other in order to give a predetermined slope to the top panel 40. The metallic fastening pins 22, 23, 24 and so forth which are associated with the packing-blocks 17, 18 have lengths which increase in value as a function of the progressively increasing heights of the packing-blocks. Moreover, the method of assembly of the panel is the same as the method described in previous embodiments.

In the form of construction illustrated in FIGS. 11 and 12, the coupling between the panels 1 and 2 at the ends of the wall is carried out by means of beams having three upright members 15*a*, 15*b* as in the embodiment shown in FIGS. 7 and 8. In this example, however, the metallic fastening pins 4 are replaced by fastening elements constituted by metallic hooks or hooking pins 30 which are inserted through the slots 13 formed in the polystyrene plates 2 in such a manner as to ensure that the hooks tightly embrace the upright member 15*b*. The hooks 30 are then pulled inwards in the direction of the arrow shown in FIG. 12 until they project within the sectional member 12. A cylindrical rod 14 is then placed between the two ends of each hook 30, the length of said rod being greater than that of the elongated slots 13. The two ends of the wire which forms the hook 30 are then twisted together with a pair of pliers and bent-back within the channel of the sectional member 12 (the right-angled flanges of said sectional member being intended to form longitudinal extensions designated by the reference 12*a* and applied against the edges of the channels 11). By way of example, the hooks 30 are made of galvanized wire having a fairly high degree of stiffness.

Attachment of the insulating plates 2 to the beams 15*a*, 15*b* is thus carried out in a simple and economical manner, whereupon the plaster-board plate is fixed on the flanges 12*a* by screwing.

In the alternative mode of execution shown in FIG. 5, the flanged channel bars 34 are provided at the bottom of the channels with a series of square openings 35 spaced at intervals which are practically equal to the sides of said openings or slots 35. The sectional members or flanged channel bars 34 are placed vertically opposite to vertical upright members 15*b* of the end beams. Hooks or pins 30 are passed through the slots 35 and through plates of insulating material in order to grip the vertical upright members 15*b* and to complete the inner panel assembly in accordance with the same method as described in the foregoing.

The alternative design of the wall which is illustrated in FIG. 13 makes provision for packing-blocks 36 disposed at intervals between the ends of the panels and constituted by a half-block 37 of concrete as well as by a half-block 38 of insulating material such as polystyrene, for example, these two half-blocks being suitably coupled together.

The outer panel 39 in this example is constituted by a form or shutter traversed by the free end portions 7*a* of the fastening pins 4, the arms 7 of which extend through the composite packing-blocks 36. The space between the shutter 39 and the inner panel 2 is filled with concrete, the projecting end portions 7*a* of the free ends 7 are then cut off and the shutter 39 is removed.

The invention is not limited to the different embodiments described in the foregoing and can accordingly extend to many alternative modes of execution.

What is claimed is:

1. A prefabricated wall primarily for the construction of dwelling houses and comprising an insulating inner panel and an outer panel assembled together by coupling means so as to form between said panels an internal space which can subsequently be filled with no-fines or light concrete, wherein the insulating inner panel is provided with superposed horizontal channels fitted with U-section members or flanged channel bars having uniformly spaced slots and flush-mounted within said channels, and wherein the coupling means are provided at the ends of the wall with metallic fastening elements which pass through the slots as well as the insulating material and extend on each side of vertical upright members forming part of end beams against which the internal panel is applied, said fastening elements being bent back within the sectional members whilst the coupling means provided between the ends of said panels comprise a series of metallic fastening pins disposed at intervals and each constituted by a loop, the ends of said loop being twisted and provided with two free end extensions, the fastening pins being positioned in such a manner that the loops of said pins pass through the insulating inner panel whilst the free ends of said pins pass through packing-blocks placed within the internal space and are anchored in the outer panel.

2. A prefabricated wall as claimed in claim 1, wherein the intermediate packing-blocks are disposed at intervals between the ends of the panels and wherein the vertical end beams which provide a connection between the panels at the ends of said panels each have at least two upright members such that one member is embedded in the outer panel whilst the other member is located within the internal space, and wherein the free ends of each fastening pin surround said two upright members and are bent-back around the upright member which is embedded in the outer panel, said outer panel being constructed of concrete.

3. A prefabricated wall as claimed in claim 1, wherein the loops of the fastening pins pass through the slots of the sectional members, are bent-back within said sectional members and are twisted around a rod which is engaged in the loop within the interior of the sectional member.

4. A prefabricated wall as claimed in claim 1, wherein the end beams comprise three upright members disposed in a triangle, said members being interconnected by means of a wire framework, two of said upright members being embedded in the outer concrete panel, and wherein the free ends of each of the metallic fastening pins which are associated with a beam embrace the upright member which is placed within the internal space then pass around the two upright members which are embedded in the concrete, said pins being then bent-back around said two upright members.

5. A prefabricated wall as claimed in claim 1, wherein said wall is employed as a platform roof or as a floor in which the internal space is not filled with concrete and provides horizontal ventilation.

6. A prefabricated wall as claimed in claim 5, wherein the packing-blocks housed within the internal space between the two panels have increasing heights from one edge of the wall to the other in order to give a predetermined slope to the top insulating panel, the metallic fastening pins being such as to have increasing lengths as a function of the progressively increasing heights of the packing-blocks.

7. A prefabricated wall as claimed in claim 1, wherein the outer panel is constituted by a shutter traversed by the free ends of the metallic fastening pins, the space formed between the shutter and the inner panel being filled with concrete, whereupon the projecting extremities of the free ends are cut off and the shutter is removed.

* * * * *